US006631571B2

(12) United States Patent
McMullin

(10) Patent No.: US 6,631,571 B2
(45) Date of Patent: Oct. 14, 2003

(54) SHOE CLEAT CONNECTOR

(76) Inventor: Faris W. McMullin, 12396 W. Ginger Creek, Boise, ID (US) 83713

( * ) Notice: Subject to any disclaimer, the term of this patent is extended or adjusted under 35 U.S.C. 154(b) by 28 days.

(21) Appl. No.: 10/050,606

(22) Filed: Jan. 18, 2002

(65) Prior Publication Data

US 2003/0033734 A1 Feb. 20, 2003

Related U.S. Application Data

(60) Provisional application No. 60/310,760, filed on Aug. 8, 2001.

(51) Int. Cl.[7] ..... A43B 5/00

(52) U.S. Cl. ..... 36/134; 36/114; 36/67 A; 36/67 D; 36/127

(58) Field of Search ..... 36/134, 114, 67 A, 36/67 D, 127, 116, 67 R, 62, 66, 59 R, 126, 128, 129, 131, 36 R; D2/962

(56) References Cited

U.S. PATENT DOCUMENTS

| | | | | |
|---|---|---|---|---|
| 2,223,794 A | | 12/1940 | Pierce et al. | |
| 2,342,777 A | * | 2/1944 | Wisckol | 36/114 |
| 2,624,128 A | | 1/1953 | Phillips | |
| 4,205,466 A | | 6/1980 | Collins | |
| 4,587,748 A | | 5/1986 | Collins | |
| 5,027,532 A | | 7/1991 | MacNeill et al. | |
| 5,036,606 A | | 8/1991 | Erich et al. | |
| 5,123,184 A | | 6/1992 | Ferreira | |
| 5,321,901 A | | 6/1994 | Kelly | |
| 5,628,129 A | * | 5/1997 | Kilgore et al. | 36/126 |
| D388,949 S | | 1/1998 | Savoie | |
| D391,048 S | | 2/1998 | Savoie | |
| 5,768,809 A | | 6/1998 | Savoie | |
| D408,978 S | | 5/1999 | Savoie | |
| D410,139 S | | 5/1999 | Savoie | |
| 5,960,568 A | * | 10/1999 | Bell et al. | 36/134 |
| 5,974,700 A | | 11/1999 | Kelly | |
| 6,108,944 A | | 8/2000 | Savoie | |
| 6,151,805 A | | 11/2000 | Savoie | |
| 6,154,984 A | * | 12/2000 | Adam | 36/127 |
| 6,161,315 A | * | 12/2000 | Dalton | 36/134 |
| 6,332,281 B1 | | 12/2001 | Savoie | |
| 6,397,499 B1 | | 6/2002 | Savoie | |

FOREIGN PATENT DOCUMENTS

| | | |
|---|---|---|
| DE | 196 32 537 A1 | 3/1997 |
| EP | 0 342 232 A1 | 11/1989 |
| GB | 2 028 102 A | 3/1980 |
| GB | 2 238 098 A | 5/1991 |
| WO | WO 91/03182 | 3/1991 |
| WO | WO 91/04685 | 4/1991 |
| WO | WO 91/15131 | 10/1991 |
| WO | WO 99/53791 | 10/1999 |

* cited by examiner

*Primary Examiner*—J. Mohandesi
(74) *Attorney, Agent, or Firm*—Edell, Shapiro & Finnan, LLC

(57) ABSTRACT

A shoe cleat connector for use with a receptacle attached to a shoe includes a substratum having a plurality of independent posts extending therefrom, with a retaining member disposed at a distal end and extending radially from each post. The receptacle includes a cavity with cantilevered fingers disposed near the periphery of the cavity. Each retaining member of the cleat connector includes a peripherally contoured series of adjacent planar surfaces that successively engage a corresponding cantilevered finger when the retaining members are inserted and rotated within the receptacle cavity, which results in the cleat connector being secured within the receptacle.

26 Claims, 5 Drawing Sheets

SHOE CLEAT CONNECTOR

CROSS-REFERENCE TO RELATED APPLICATIONS

This application claims priority from U.S. Provisional Patent Application Ser. No. 60/310,760, entitled "Shoe Cleat Connector", and filed Aug. 8, 2001. The disclosure of the above-mentioned provisional application is incorporated herein by reference in its entirety.

BACKGROUND OF THE INVENTION

1. Technical Field

This invention pertains generally to improvements in traction cleats for shoes and, more particularly, to an improved mounting and locking structure on a cleat by which the cleat can be selectively secured to and released from a particular commercially available retaining member mounted in a shoe sole. The particular retaining member is part of an attachment system manufactured by MacNeill Engineering Co., Inc. under the trademark Q-LOK®, and is disclosed in a variety of forms in U.S. Pat. Nos. 5,768,809 (Savoie '809), 6,151,805 (Savoie '805) and 6,332,281 (Savoie '281). The entire disclosures in those patents are incorporated herein by reference.

2. Discussion of Related Art

The Savoie '809 patent discloses a receptacle with an interior cavity having an opening formed in the receptacle bottom wall for receiving a connector of a cleat or spike. The opening has three identical and symmetrically disposed generally semi-circular lobes and is adapted to receive the cleat connector which has a central base post with three radially extending retaining members at its distal end. The three retaining members are curved to define a trilobal pattern matching the three receptacle lobes. The connector is inserted into the receptacle by first aligning the retaining member lobes with respective lobes of the receptacle opening and then axially sliding the retaining members through the opening and into the receptacle cavity. Within the cavity are three cantilevered resilient fingers or spring arms biased radially inward and designed to engage and hold respective installed retaining members.

When the inserted retaining members are rotated about the connector axis, the retaining members become axially misaligned from the lobes of the receptacle opening. A shelf surrounding the receptacle opening is defined by the interior surface of the receptacle bottom wall and axially compresses the retaining members to retain them in the cavity. The shelf is ramped in each of the three sections adjacent a respective opening lobe, thereby gradually restricting the axial depth of the cavity in three locations. Rotation of the inserted retaining members causes a protruding portion of the arcuate edge of each retaining member to contact a curved tip of a respective finger to allow the retaining member to be turned past the angular location of the finger. Once the protruding edge of a retaining member passes the location of the finger, the finger springs back to nearly its original shape so that the tip of the finger abuts the side of an adjacent lobe of a retaining member. This allows the cleat to be removed, but only by exerting sufficient torque to bend the fingers away from the surfaces of the retaining members which requires considerably greater torque than that required during installation of the retaining member. Coincident with the fingers locking into place, the protruding edge of a retaining member is blocked from further movement by stops protruding into the cavity from the receptacle outer wall. The depth of each retaining member is gradually reduced but more gradually than the cavity depth so that the engagement of the retaining member is gradually tightened with rotation. In other words, the gradual restriction of the cavity receptacle depth is designed such that each retaining member is increasingly compressed axially as the cleat is rotated to securely hold the cleat in place.

One problem with this design relates to the use of precisely matching arcuate lobe contours on the retaining members and the receptacle cavity opening. These matching contours require precise axial as well as rotational alignment during axial insertion of the retaining members into the cavity. In addition, the smoothly arcuate periphery makes it difficult for the resilient cavity fingers to reliably perform the function of locking the retaining member against reverse rotation. In fact, this has resulted in Savoie providing a notch in the retaining member periphery in some of the embodiments disclosed in the Savoie '809, '805 and '281 patents.

In addition, the use of a central post on the cleat connector prevents any resilient radial contraction of the retaining members, a feature which is desirable to facilitate both insertion of the retaining members into and their removal from the receptacle cavity.

OBJECTS AND SUMMARY OF THE INVENTION

It is an object of the present invention to provide an improved connector for a cleat suitable for insertion and engagement in the receptacle disclosed in the Savoie '809 '805 and '281 patents.

It is another object of the invention to provide an improved connector and method for attaching a traction cleat to a Q-LOK® system without the disadvantages noted hereinabove.

A further object of the present invention is to provide a method and apparatus for simplifying the insertion of a replacement cleat into a receptacle mounted in a shoe sole.

The aforesaid objects are achieved individually and in combination, and it is not intended that the present invention be construed as requiring two or more of the objects to be combined unless expressly required by the claims attached hereto.

In accordance with the present invention, an improved traction cleat is provided with a connector that fits into and lockingly engages the receptacle of the aforementioned Savoie patent attachment system. The connector, instead of having a rigid central post from which three retaining members radially extend, has a plurality of independent posts, one for each retaining member. The posts are preferably symmetrically disposed about and slightly radially spaced from the central longitudinal axis of the cleat, and can be pivotally flexed slightly during insertion and removal of the connector relative to the connector cavity. The retaining members project radially outward from respective posts and are peripherally contoured as a series of adjacent planar surfaces rather than arcuately with a curvature to match the lobes of the receptacle opening. The linear junctions defining the intersections between adjacent outer facets or surfaces of the retaining members are radially spaced from the cleat longitudinal axis by a distance slightly less than the radial distance of the outermost portion of the lobes of the receptacle opening from the receptacle longitudinal axis.

When inserting the cleat connector into the receptacle opening, the faceted retaining members need only be generally aligned (as opposed to strict axial and rotational alignment) with the receptacle lobes. When one of the cleat retaining members is placed partially in one of the receptacle opening lobes, even if the cleat longitudinal axis is skewed relative to the receptacle longitudinal axis, the cleat can be moved laterally to force the partially inserted retaining member against the receptacle lobe edge. The force causes the post supporting that retaining member to resiliently pivot radially inward to reduce the overall radial dimension of the three-post assembly. At the same time, the linear edge of the retaining member that is in contact with the lobe edge act as a pivot to naturally turn the cleat to facilitate alignment of the retaining member with the lobe. This serves to similarly align the other two retaining members with respective receptacle opening lobes. The result is a smooth fit and insertion of the cleat connector into the receptacle cavity.

When the inserted retaining members are rotated, each receptacle finger ultimately abuts a particular perimetric facet or planar surface that is oriented at an angle to the finger thus preventing inadvertent reverse rotation and loosening of the cleat in the receptacle while permitting reverse rotation in response to intentionally applied torque during removal of the cleat.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF PREFERRED EMBODIMENTS

Figure 1:
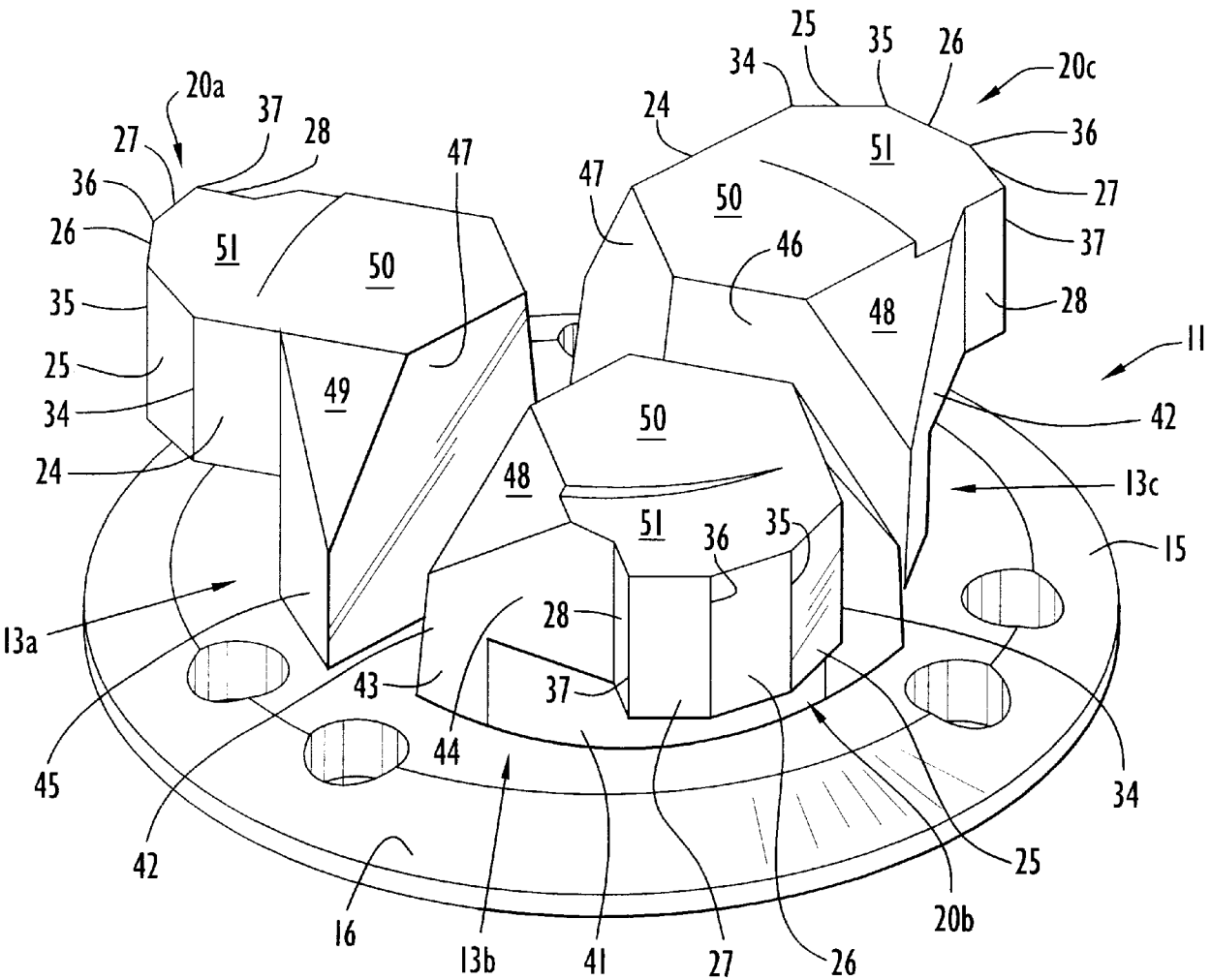
FIG. 1 is a view in perspective from above and one side of a cleat connector of the present invention.
Figure 2:
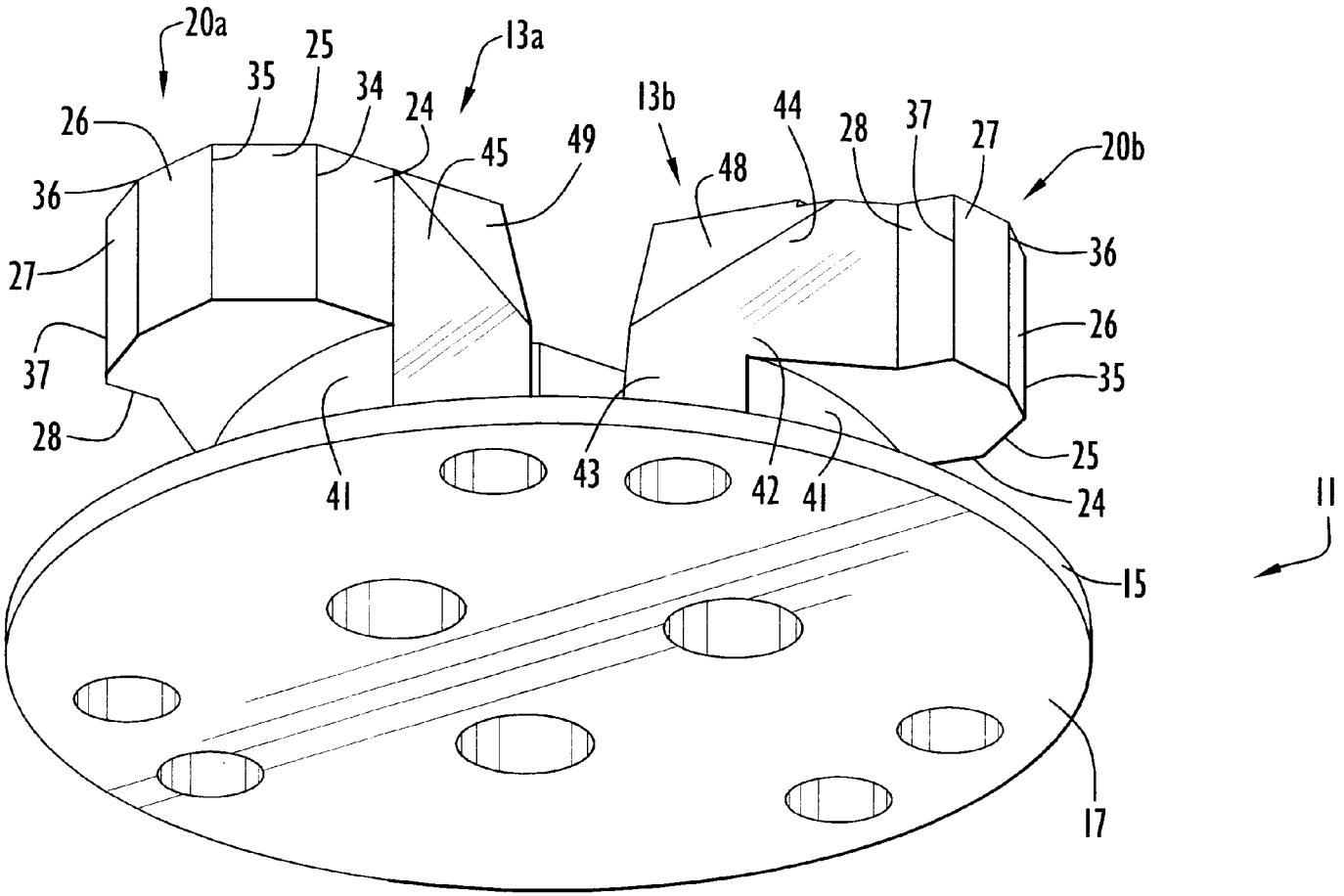
FIG. 2 is a view in perspective from below of the cleat connector of FIG. 1.
Figure 3:
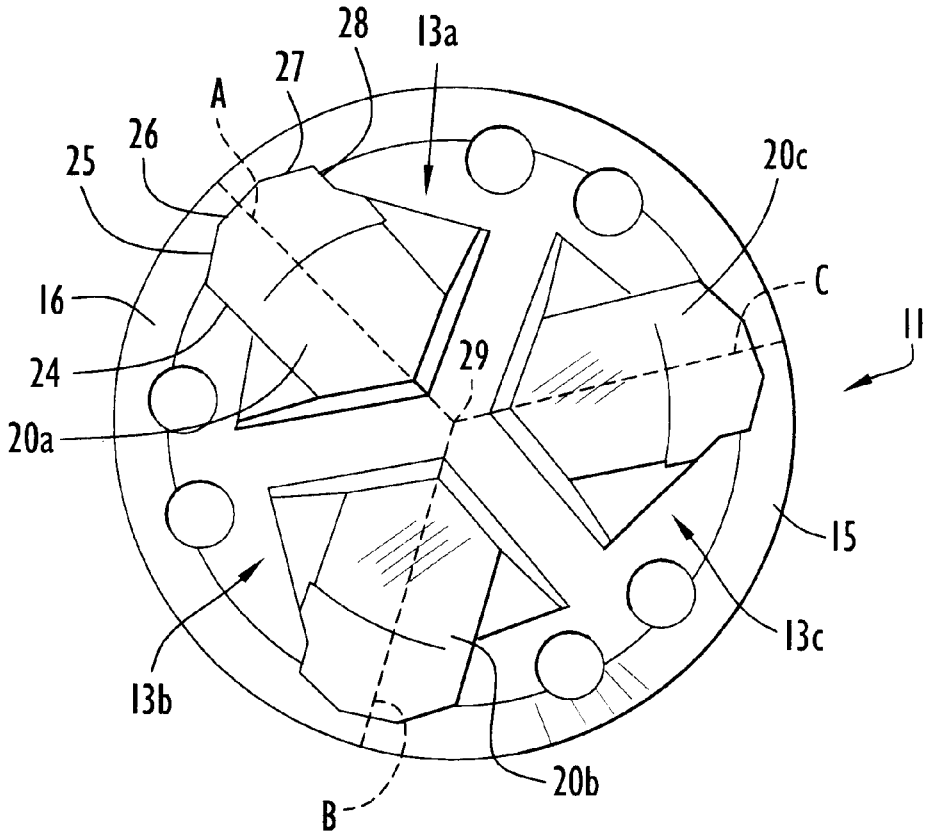
FIG. 3 is a top view in plan of the cleat connector of FIG. 1.
Figure 4:
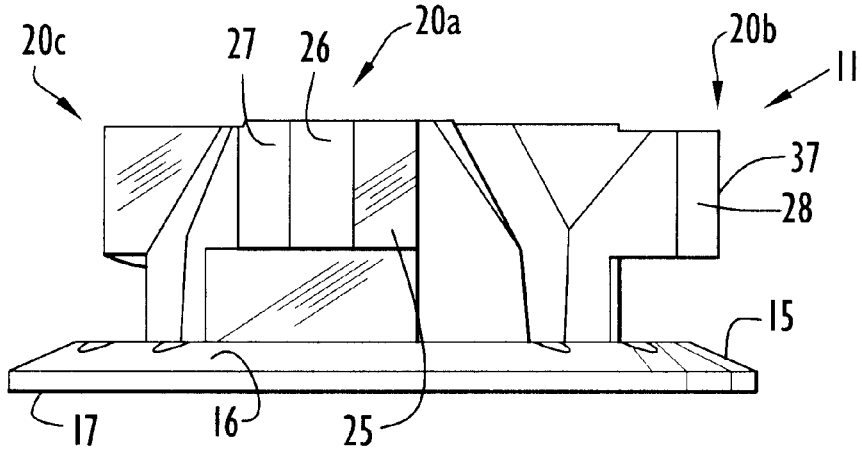
FIG. 4 is a side view in elevation of the cleat connector of FIG. 1.

The present invention includes a system for allowing the quick attachment and release of cleats with traction elements, such as those disclosed in U.S. Pat. No. 6,023,860 (McMullin), to the underside of athletic footwear. The disclosure in that patent is incorporated herein in its entirety by reference. The traction elements themselves form no part of the present invention. It is to be understood, however, that substantially any type of traction element can be used in conjunction with connector structure described and illustrated herein. Referring to FIGS. 1–4, a cleat connector 11 comprises a base or substratum 15 having a bottom surface 17 and top surface 16. It is to be understood that the terms "top surface" and "bottom surface" as used herein respectively refer to surfaces of the cleat connector that face toward or away from the receptacle that secures the cleat connector. Traction elements (not shown) typically project generally in the opposite direction away from the bottom surface 17. The top surface 16 may be flat, concave or convex, depending on the contour of the receptacle and the shoe sole in which the receptacle is mounted.

Three posts or base members 13*a*, 13*b* and 13*c* are formed integrally with and project in a generally tapered configuration away from top surface 16 of the substratum. The posts are positioned on respective 120° angularly spaced radii A, B and C, around a central longitudinal axis 29 of the cleat, and are equally radially spaced along surface 16 from that axis. Each post 13 has a multifaceted configuration and serves as a support for a respective retaining member 20*a*, 20*b* and 20*c* disposed at the distal end of the post. The multifaceted configuration of each post 13 includes a generally planar, multi-sided upper surface 50 that is substantially parallel to substratum 15. The lower front base portion of each post 13 includes a semi-circular or arcuate surface 41 extending from and facing the outer periphery of the substratum surface 16. The arcuate surfaces 41 are all disposed on a circle having a center defined by central longitudinal axis 29 and a diameter that is slightly less than the smallest diameter defined by the opening 40 in the Savoie receptacle illustrated in FIGS. 6 and 7. Extending from opposing ends of each arcuate surface 41, in a direction slightly inward and toward longitudinal axis 29, are substantially planar surfaces 42 and 45.

Planar surfaces 42 and 45 are both oriented substantially perpendicular to substratum 15 but have different geometric configurations with respect to each other. Planar surface 42 includes a generally rectangular lower section 43 forming a portion of the post base with one end intersecting at a linear junction with the corresponding end of the arcuate lower surface 41 and an opposing end intersecting at a linear junction with a substantially planar first back surface 46. The first back surface 46 is oriented substantially perpendicular to substratum 15 and extends at an acute angle from the lower section 43 toward the central longitudinal axis 29 of substratum 15. Planar surface 42 further includes an upper section 44 positioned above the arcuate surface 41 and extending radially outward toward the outer periphery of substratum surface 16. The upper section 44 intersects at a first linear junction with one side of the top surface 50 and at a second linear junction with an end of a corresponding retaining member 20. These first and second linear junctions intersect to form an upper front corner of upper section 44 that is adjacent the respective retaining member 20. Upper section 44 has a generally rectangular configuration with a chamfered or truncated upper rear corner opposing the upper front corner. Similarly, the first back surface 46 has a generally rectangular configuration with a truncated upper corner proximate the truncated upper rear corner of upper section 44 and an upper end intersecting at a linear junction with a first rear side of the top surface 50. A substantially planar and triangular surface 48 is disposed between and intersects at corresponding linear junctions with the truncated corners of upper section 44 and first back surface 46 as well as a further side of top surface 50. The triangular surface 48 is oriented at a non-perpendicular angle with respect to each of the top surface 50 of the post 13 and substratum 15.

Planar surface 45 includes a front end that extends from the top surface 16 of substratum 15 to the top surface 50 of post 13. This front end further intersects at a linear junction with a corresponding end of the arcuate lower surface 41 as well as an end of the corresponding retaining member 20. Planar surface 45 further has a generally rectangular configuration with a truncated upper rear corner opposing its front end. A rear end of planar surface 45 intersects at a linear junction with one end of a substantially planar second back surface 47. The second back surface 47 extends at an acute angle from surface 45 toward the first back surface 46 and intersects the first back surface 46 at a linear junction to form an obtuse angle at the back portion of the post 13. The second back surface 47 is also generally rectangular with an upper end intersecting at a linear junction with a second rear side of the top surface 50 and a truncated upper corner proximate the truncated upper rear corner of surface 45. Disposed between and intersecting at linear junctions with these truncated corners as well as another side of the post top surface 50 is a substantially planar and triangular surface 49. The triangular surface 49 is further oriented at a non-perpendicular angle with respect to each of the post top surface 50 and substratum 15. As is evident from FIGS. 1–4, each post 13 is asymmetric along a respective angularly spaced radius A, B or C, with the back surfaces 46 and 47 of each post 13 extending toward the central longitudinal axis 29 of substratum 15 and the planar surface 42 of each post proximate the planar surface 45 of a neighboring post. It is noted that this geometric configuration for each of the posts is merely exemplary and in no way limits the present invention to such a configuration.

Each retaining member 20 includes a radially projecting segment extending from a distal end of a respective post 13 above the arcuate lower surface 41 and between planar surfaces 42 and 45. In contrast to the arcuate or semi-circular outer surfaces of the retaining members disclosed in the Savoie patents, the outer surface of each retaining member 20 is made up of a peripherally-extending series of substantially planar facets 24, 25, 26, 27 and 28 intersecting at respective linear junctions 34, 35, 36 and 37. The planar facets reside in respective planes that extend substantially perpendicular to substratum 15. Likewise, linear junctions 34, 35, 36 and 37 are substantially perpendicular to the substratum. These linear junctions form obtuse-angle corners, all of which are radially spaced from the cleat central longitudinal axis 29 by a distance slightly less than the outermost portion of the edge of the lobes in the opening 40 in the Savoie receptacle illustrated in FIGS. 6 and 7. In the cleat embodiment illustrated herein, facets 24 and 28 of each retaining member 20 are parallel to one another and to the respective position-determining radius (A, B or C) for the retaining member. Facet 24 intersects at the linear junction with the previously described front end of surface 45 of a respective post 13, whereas facet 28 intersects at the second linear junction with the previously described upper section 44 of surface 42 of the respective post. The angle between facets 24 and 25 at linear junction 34 is approximately 130°; the angle between facets 25 and 26 at linear junction 35 is approximately 145°; the angle between facets 26 and 27 at linear junction 36 is approximately 155°; and the angle between facets 27 and 28 at linear junction 37 is approximately 110°. In this arrangement, linear junction 36 defines the radially outermost part of the retaining member 20, and is radially spaced form axis 29 to just fit into a receiving lobe in the receptacle opening of the Savoie receptacle. It is to be understood that the previously described angles are merely approximations for the embodiment of FIGS. 1–4, and that the present invention is not limited to the number of facets and intersecting angles of this embodiment. In other words, each retaining member may include any number of substantially planar facets intersecting with each other at any variety of selected angles.

The radial spacing of posts 13*a*, 13*b* and 13*c* from axis 29 permits each post to resiliently and independently pivot about its base during insertion of the cleat connector into a receptacle. The specific radial spacing is not of itself important as long as the spacing between posts is sufficient to permit a desired degree of resilient flexure. As noted above, the individual posts are multi-sided and taper away from top surface 16 of the substratum. The taper provides enhanced strength at the base of each post 13 while permitting most of the post movement during pivotal flexure to occur distally at the retaining member 20.

Figure 6:
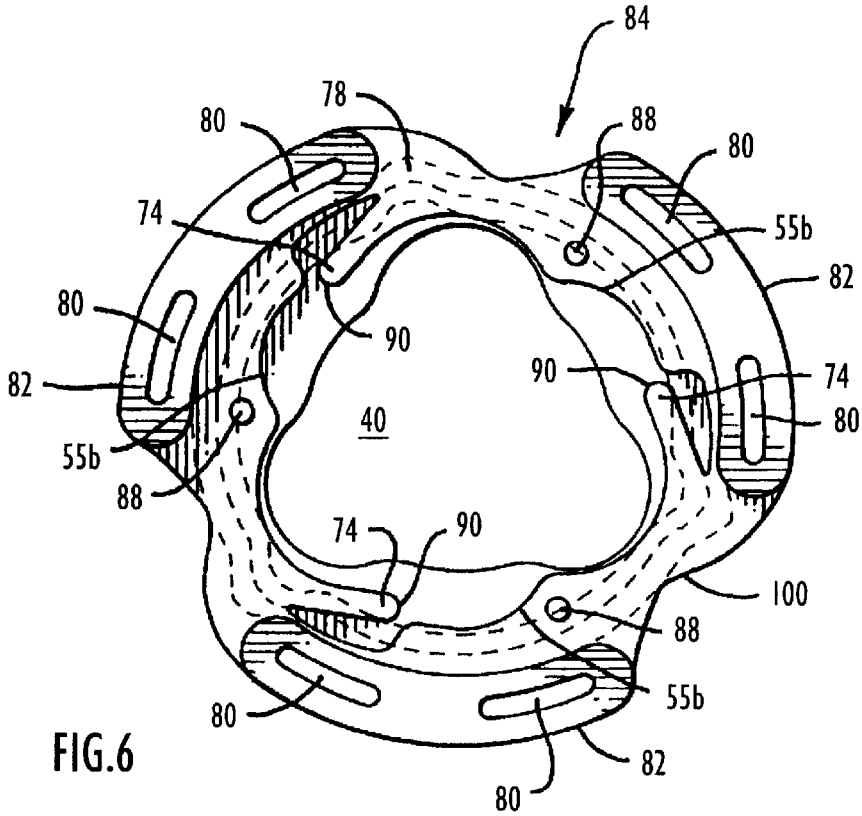
FIG. 6 is a top view in section of a receptacle to which the cleat connector of the present invention is designed to attach and lock.
Figure 7:
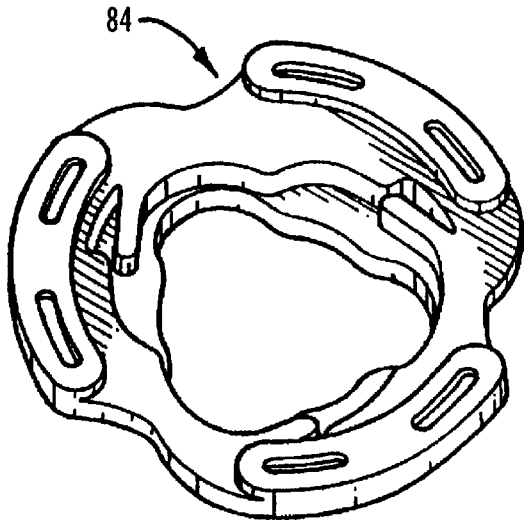
FIG. 7 is a view in perspective of the receptacle of FIG. 6.

The radially outward extension of each retaining member 20 and its other dimensions are selected to permit the connector to operate in conjunction with the receptacle illustrated in FIGS. 6 and 7. Additionally, a portion of the top surface 50 of each post 13 includes a tapered or ramped section 51 that overlies the respective retaining member 20. The ramped section 51 extends across the top surface 50 in a semi-circular direction substantially aligned with the arcuate surface 41 at the base of the post 13 such that a low point of the ramped section (i.e., the point at which there is the greatest separation between the ramped section and the remainder of the top section) overlies surface 42 of the post 13 and a high point of the ramped section, which is substantially coplanar with the remainder of the top surface 50, overlies facet 24 of the retaining member 20. A ledge is thus formed on the top surface 50 between the ramped section 51 and the remainder of the top surface. The ramped sections of the posts cooperate with the tapered depth of the cavity, as disclosed in the Savoie '809 patent, to permit increasing depth-wise compression of the retaining members as they are rotated in the receptacle during installation of the cleat.

Referring to FIGS. 6 and 7, there are reproduced drawings of the receptacle shown in the Savoie '809 patent. That receptacle is not part of the present invention and is depicted herein only to facilitate an understanding of the manner in which the cleat connector of the present invention cooperates with that receptacle. The view in FIG. 6 is a section view in which the top layer of the receptacle 84 has been removed to show the inner-cavity structure for receiving the retaining member 20, and FIG. 7 shows a perspective view of the receptacle. Included within the cavity, formed by wall portion 78, are three cantilevered fingers 74, each designed to engage a respective installed retaining member 20. When a retaining member is inserted and twisted or rotated, the rotating action causes the radially-outer faceted surface of the retaining member to push and outwardly flex finger 74 to allow successive linear junctions 37, 36, 35 and 34 to be rotated past the location of the finger. Once linear junction 34 passes the location of the finger 74, the finger springs back to nearly its original shape, so that its end portion 90 contacts facet 24. In this position the finger points partially at facet 24 and resists inadvertent reverse rotation and loosening of the cleat, thereby providing a locking feature without the need for an indentation into the retaining member periphery. Further rotation of the retaining members in this same direction beyond the locking point (i.e., the point at which each linear junction 34 passes a respective finger 74) is further limited by respective bumps or protrusions 55*b* disposed to abut the outer portion of facet 28 near linear junction 37.

During intentional removal of the cleat from the receptacle (i.e., for cleat replacement), a reverse torque is applied to the cleat (i.e., in a conventional manner as with a tool designed for this purpose) and the rounded contour at the distal end of finger 74 is caused to flex and ride radially along facet 24 until it passes linear junction 34. The finger tip then rides along successive facets and past successive linear junctions as the finger is flexed accordingly until facet 28 clears the finger. This allows the retaining members to be positioned in general alignment with respective lobes of the receptacle opening so that the cleat can be removed from the receptacle. It is noted that the torque required for removal is greater than that required for insertion since the force applied to finger 74 during reverse rotation has a relatively large component directed longitudinally along finger 74 by facet 24 and only a small perpendicular component that produces flexure of the finger. On the other hand, during insertion, the larger force component is applied to the finger in the direction of flexure.

Also shown in FIG. 6 is an embodiment for attaching receptacle 84 to the underside of footwear by the use of mounting slots 80. The perimeter 100 of the receptacle 84 comprises three flanges disposed around the receptacle opening 40. Within each flange 82 of the perimeter are two slots 80 for mounting the receptacle 84 to footwear. Mounting of the receptacle is effected by methods known in the art, and may include forming sole material around the slots, or inserting a pin or other object through the slot to effectively nail the receptacle to an inner-sole of a shoe, and then forming the outer-sole material around the receptacle so affixed. The slots 80 are separated by a specified distance and are preferably curved to conform to the curvature of the flange 82 in which the slots 80 are set. Also shown are three openings 88 to allow for attaching a receptacle a cover for the receptacle 84. Alternatively, the receptacle may be secured in the sole by the compression molding technique disclosed in U.S. Pat. No. 6,248,278 (Kelly), which is incorporated herein by reference in its entirety.

The faceted configuration of retaining members 20 allows insertion of cleat 11 into receptacle 84 where the retaining members are only be generally aligned (as opposed to being in strict axial and rotational alignment) with the receptacle lobes. When one of the linear junctions between facets is placed partially in one of the receptacle opening lobes, even if the cleat longitudinal axis 29 is skewed relative to the receptacle longitudinal axis, the cleat can be jiggled or moved laterally to force the partially inserted retaining member against the receptacle lobe edge. The force causes the post supporting that retaining member to resiliently pivot so that the retaining member moves radially inward to temporarily reduce the overall radial dimension of the three-post assembly. At the same time, the linear junction that is in contact with the lobe edge acts as a pivot point to naturally turn the cleat to direct the retaining member into alignment with the lobe. This serves to similarly align the other two retaining members with respective lobes of the receptacle. The result is a smooth fit and insertion of the cleat connector into the receptacle cavity.

It is to be understood that the embodiments described above and illustrated in the drawings represent only some of the many ways of implementing a shoe cleat connector according to the present invention.

The cleat connector of the present invention may employ any number of posts (i.e., at least two) and retaining members suitable for use with receptacles of varying geometric configurations. While the embodiments described above and illustrated in the figures, which employ three posts and corresponding retaining members, are preferred to correspond with the specific receptacles described in the Savoie '281, '805 and '809 patents, it is noted that those embodiments may be easily modified, for example, to accommodate receptacles having greater or less than three lobes and corresponding cantilevered locking fingers.

The cleat and connector may be made of any suitable material including, without limitation, molded plastic, rubber or metal. The material used for the substratum and the connector is preferably of greater hardness than the material used for the traction elements in order to provide a rigid support structure for the traction elements and to provide for secure attachment of the cleat to a shoe. With regard to the attachment function, the greater rigidity of the substratum permits it to hold its shape and be less likely to become dislodged when subjected to forces during use. The softer material used for the traction elements impart resilience to those elements. A desired resilience of the posts to permit pivotal flexibility as described above is preferably achieved from the tapered post structure rather than from the material from which the posts are formed. For example, the substratum and connector material might have a Durometer scale hardness on the order of 70D whereas the traction elements typically have a hardness in the range of 82A to 88A. The preferred material for the support pads and traction elements is polyurethane, but other plastics and rubbers having the characteristics described herein may be employed. The substratum may be polyurethane or any other suitable plastic or rubber material having any desired degree of hardness.

The posts of the cleat connector may be separately attached to the substratum as depicted in the embodiments described above or, alternatively, combined at a base portion that connects to the substratum. When commonly joined at a base secured to the substratum, the posts are preferably separated from each other at their distal ends to facilitate independent pivotal flexibility of each post with respect to the substratum.

In a further embodiment, the multifaceted retaining members may radially extend from a single post secured to the substratum, where each retaining member is further provided with independent flexibility with respect to the post. For example, the distal end of each retaining member may extend angularly in cantilevered fashion such that the laterally exerted force on the distal end during insertion causes the insertion member end to flex radially inward to facilitate the insertion process.

The junctions 34–37 between the facets may be linear notches (i.e., indentations) rather than outwardly extending linear corners. Such notches could have any transverse cross-sectional configuration, such as V-shaped, U-shaped, etc. The notch junctions tend to provide greater tactile feedback to the person inserting the cleat than do the corner junctions as the junctions are rotated past the flexed finger 74.

The retaining members may include any number of faceted surfaces forming the perimeter of each retaining member with adjacent facets intersecting at any suitable angles. The number and orientation of facets for each retaining member may be the same or vary, depending upon the geometry of the receptacle with which the cleat connector is to be engaged. The facets are preferably substantially planar. However, each facet may have any geometric configuration (e.g., concave, convex, etc.) suitable for use with a particular receptacle. Additionally, each facet may be oriented in any suitable manner with respect to the substratum (e.g., perpendicular or non-perpendicular).

Figure 5:
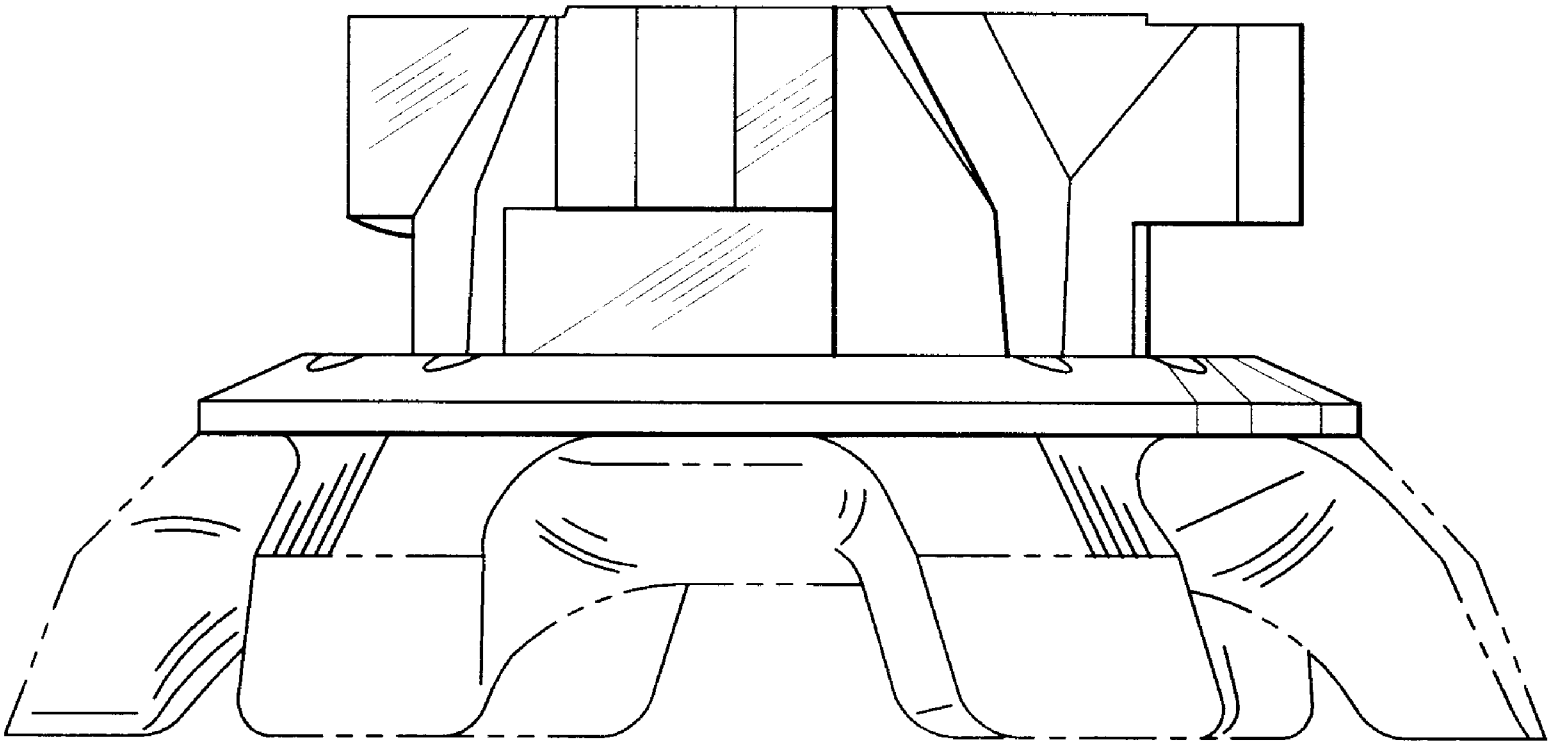
FIG. 5 is a side view in elevation of a cleat showing cleat traction elements and the connector of the present invention.

There are numerous known traction element configurations that can be used in conjunction with the cleat connector of the present invention, one example being illustrated in FIG. 5. Some other examples may be found in the following U.S. Patents, the entire disclosures in each being incorporated herein by reference:

| U.S. Pat. No. | Issue Date | Patentee |
|---|---|---|
| 5,321,901 | Jun. 21, 1994 | Kelly |
| 5,367,793 | Nov. 29, 1994 | Deacon et al. |
| 5,524,367 | Jun. 11, 1996 | Ferreira et al. |
| Des. 385,988 | Nov. 11, 1997 | McMullin |
| Des. 401,046 | Nov. 17, 1998 | McMullin |
| Des. 404,192 | Jan. 19, 1999 | McMullin |
| 5,860,228 | Jan. 19, 1999 | Bathum |
| 5,887,371 | Mar. 30, 1999 | Curley |
| Des. 407,893 | Apr. 13, 1999 | McMullin |
| Des. 408,122 | Apr. 20, 1999 | McMullin |
| Des. 415,340 | Oct. 19, 1999 | McMullin |
| 5,974,700 | Nov. 2, 1999 | Kelly |
| 5,996,260 | Dec. 7, 1999 | MacNeill |
| 6,052,923 | Apr. 25, 2000 | McMullin |
| 6,167,641 | Jan. 2, 2001 | McMullin |
| Des. 432,770 | Oct. 31, 2000 | Breault |
| Des. 439,396 | Mar. 27, 2001 | Savoie |
| Des. 439,733 | Apr. 3, 2001 | Savoie |

The particular materials and dimensions described herein are intended only as examples and are not limitations to be placed on the invention.

One aspect of the present invention is a method of attaching a cleat to a shoe-mounted receptacle of the type having a cavity and a plurality of arcuate openings for permitting axial insertion of cleat retaining members into the receptacle cavity and subsequent rotation of the inserted retaining members within the cavity. The method involves permitting radially inward resilient flexure of the retaining members during their insertion through the cavity openings to facilitate passage of said retaining members into the cavity.

Another aspect of the invention involves providing the outward facing engagement surface of each retaining member with plural facets intersecting at linear junctions to permit the junctions to contact and move along the peripheral arcuate edge of a cavity opening during insertion of the retaining members into the cavity to facilitate alignment of all of the retaining members with respective cavity openings.

In more specific terms, the invention described herein is a rotationally attachable cleat for footwear having a ground-facing side and a shoe sole-facing side, and a longitudinal axis oriented generally vertically in use. A ground engaging member is disposed at the ground-facing side and an attachment structure is disposed at the shoe sole-facing side. The attachment structure has at least two spaced radially extending retaining members configured to be axially inserted through corresponding openings in a cleat receptacle to permit rotation of the retaining members within the receptacle. Each retaining member is provided with a radially outward facing engagement surface comprising a plurality of flat planar facets intersecting at angularly spaced linear junctions extending generally parallel to the cleat longitudinal axis. In this regard, the engagement surface may be viewed as part of a polygon rather than an arcuate surface of the type characteristic of the structure described in the Savoie patents. Each engagement surface has an angular center is asymmetric relative to a respective transverse axis extending radially from the cleat longitudinal axis through the angular center of a respective engagement surface. The attachment structure includes resilient flexure means for permitting radially inward resilient displacement of the retaining members during insertion of said retaining members through said receptacle openings. In the preferred embodiment the attachment structure comprises a plurality of independent posts disposed at respective locations radially spaced from the cleat longitudinal axis on the sole-facing side of said cleat, the posts extending in a direction substantially parallel to said longitudinal axis. Each post has a distal end with a respective one of the retaining members extending generally radially outward therefrom. The resilient flexure feature in this embodiment is provided by the resilient material of the posts permitting radial and a angular flexure of the distal ends of the posts.

Having described preferred embodiments of new and improved shoe cleat connectors, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat having a connector adapted for attachment to a receptacle mounted on a shoe sole, said cleat comprising:

a base including first and second oppositely facing surfaces, said first surface being adapted to face said shoe sole and having said connector disposed thereon, said second surface having at least one traction element secured thereto;

wherein said connector comprises:

a plurality of posts extending axially from the first surface generally toward said shoe sole, said posts terminating at respective distal ends axially spaced from the first surface and transversely from each other; and a plurality of retaining members disposed at the distal ends of and extending generally radially from respective posts, wherein each retaining member includes a peripherally contoured series of adjacent and substantially planar retaining surfaces that are configured to be received in an opening and retained within a cavity of the receptacle.

2. The cleat of claim 1, wherein said plurality of posts is three posts disposed at 120° angularly spaced locations about an axis extending generally perpendicular to said first surface.

3. The cleat of claim 1, wherein said posts are each resiliently and independently pivotable with respect to the first surface.

4. The cleat of claim 1, wherein the plane of each retaining surface is substantially perpendicular to the base.

5. The cleat of claim 1, wherein the cavity of the receptacle includes a central longitudinal receptacle axis and a plurality of curved lobes extending radially from the receptacle axis, wherein the connector includes a longitudinal connector axis adapted to be coaxial with the receptacle axis when the connector is attached to the receptacle, and wherein the maximum spacing of each retaining surface from said connector axis is equal to or less than the maximum distance from the receptacle axis to each receptacle lobe.

6. A cleat connector for attachment to a receptacle disposed on a shoe comprising:

a base including a first surface to attach the base to the receptacle and a second surface to attach a traction element to the base; and a retaining member coupled to the base a selected distance from the first surface, wherein the retaining member includes a peripherally contoured series of adjacent and substantially planar retaining surfaces selectively dimensioned and aligned to be received and retained within a cavity of the receptacle.

7. The cleat connector of claim 6, further comprising three retaining members disposed at 120° angularly spaced locations about an axis extending generally perpendicular to said first surface.

8. The cleat connector of claim 6, wherein the retaining member is resiliently pivotably secured to the first surface.

9. The cleat connector of claim 6, wherein each retaining surface is in a respective plane that is substantially perpendicular to the base.

10. The cleat connector of claim 6, wherein the cavity of the receptacle includes a radially extending lobe, and wherein each retaining surface of the connector extends a distance from a central axis of the first surface that is less than a distance from the central axis of the cavity to an outermost portion of the lobe.

11. A method of installing a cleat connector into a receptacle attached to a shoe, wherein the cleat connector includes a base with a first surface to attach the base to the receptacle and a second surface to attach a traction element to the base, a plurality of posts extending transversely from the first surface and terminating at distal ends separated from each other, and a retaining member disposed at the distal end of and extending radially from each post, the method comprising:

(a) facilitating the insertion of each retaining member into a cavity formed in the receptacle; and (b) facilitating the rotation of the retaining members to engage a locking mechanism within the cavity so as to secure the cleat connector to the receptacle.

12. The method of claim 11, wherein the cavity includes a plurality of lobes corresponding to the retaining members and step (a) includes:

(a.1) facilitating a pivoting flexibility of each post with respect to the base to permit insertion of a retaining member within the cavity at a corresponding lobe when a longitudinal axis of the cleat connector is skewed with respect to a longitudinal axis of the receptacle.

13. The method of claim 11, wherein the locking mechanism includes a plurality of resilient fingers disposed within the receptacle, each retaining member includes a peripherally contoured series of adjacent and substantially planar retaining surfaces, and step (b) includes:

(b.1) facilitating successive engagement of retaining surfaces of each retaining member with a corresponding finger, during rotation of the retaining members within the cavity, to force the corresponding finger toward an outer periphery of the cavity; and (b.2) facilitating a locking engagement between the corresponding finger and a terminal retaining surface within the series of adjacent retaining surfaces of each retaining member.

14. A cleat connector for attachment to a receptacle disposed on a shoe, the receptacle including a cavity and a plurality of locking members disposed within the cavity, the cleat connector comprising:

a means for supporting a cleat; and a plurality of means for securing the means for supporting to the receptacle, wherein each means for securing is securable within the cavity and includes a series of adjacent means for successively engaging a corresponding locking member when each means for securing is inserted into the cavity.

15. The cleat connector of claim 14, wherein each means for securing is independently pivotable with respect to the means for supporting.

16. A rotationally attachable cleat for footwear having first and second sides and a longitudinal axis oriented generally vertically in use, said cleat comprising:

a ground engaging member at said first side; and an attachment structure at the second side including at least two spaced radially extending retaining members configured to be axially inserted through corresponding openings in a cleat receptacle to permit rotation of the retaining members within the receptacle, each retaining member including a radially outward facing engagement surface comprising a plurality of flat planar facets intersecting at angularly spaced linear junctions extending generally parallel to said longitudinal axis.

17. The cleat of claim 16 wherein each engagement surface has an angular center, and wherein each engagement surface is asymmetric relative to a respective transverse axis extending radially from said longitudinal axis through the angular center of a respective engagement surface.

18. The cleat of claim 16 wherein said attachment structure includes resilient flexure means for permitting radially inward resilient displacement of said retaining members during insertion of said retaining members through said receptacle openings.

19. The cleat of claim 18 wherein said attachment structure comprises a plurality of independent posts disposed at respective locations radially spaced from said longitudinal axis on said second side of said cleat, said posts extending in a direction substantially parallel to said longitudinal axis, each post having a distal end with a respective one of said retaining members extending generally radially outward therefrom, and wherein said resilient flexure means comprises resilient material of said posts permitting radial and angular flexure of the distal ends of the posts.

20. The cleat of claim 16 wherein said linear junctions are radially outward facing corner junctions.

21. The cleat of claim 16 wherein said linear junctions are radially inward recesses demarking the intersections of said facets.

22. A rotationally attachable cleat for footwear having first and second sides and a longitudinal axis oriented generally vertically in use, said cleat comprising:

a ground engaging member at said first side;

an attachment structure at the second side including at least two spaced radially extending retaining members configured to be axially inserted through corresponding openings in a cleat receptacle to permit rotation of the retaining members within the receptacle, wherein each retaining member includes a radially outward facing engagement surface comprising a plurality of flat planar facets intersecting at angularly spaced linear junctions extending generally parallel to said longitudinal axis; and flexure means for permitting said retaining members to be resiliently displaced in at least a radially inward direction in response to lateral forces applied thereto during insertion of said retaining members into said openings in a cleat receptacle.

23. The cleat of claim 22 wherein said attachment structure comprises a plurality of independent posts disposed at respective locations radially spaced from said longitudinal axis on said second side of said cleat, said posts extending in a direction substantially parallel to said longitudinal axis, each post having a distal end with a respective one of said retaining members extending generally radially outward therefrom, and wherein said flexure means comprises resilient material of said posts permitting radially inward flexure of the distal ends of the posts.

24. A method of attaching a cleat to a shoe-mounted receptacle of the type having a cavity and a plurality of arcuate openings for permitting axial insertion of cleat retaining members into the receptacle cavity and subsequent rotation of the inserted retaining members within the cavity, said method comprising the step of:

permitting radially inward resilient flexure of said retaining members during insertion thereof through the cavity openings to facilitate passage of said retaining members into the cavity and rotation of the retaining members with respective cavity openings.

25. The method of claim 24 further comprising the step of:

providing the outward facing engagement surface of each retaining member with plural facets intersecting at linear junctions to permit the junctions to contact and move along the peripheral arcuate edge of a cavity opening during insertion of the retaining members into the cavity to facilitate alignment of all of the retaining members with respective cavity openings.

26. A method of attaching a cleat to a shoe-mounted receptacle of the type having a cavity and a plurality of arcuate openings for permitting axial insertion of cleat retaining members into the receptacle cavity and subsequent rotation of the inserted retaining members within the cavity, said method comprising the step of:

providing the outward facing engagement surface of each retaining member with plural facets intersecting at linear junctions to permit the junctions to contact and move along the peripheral arcuate edge of a cavity opening during insertion of the retaining members into the cavity to facilitate alignment of all of the retaining members with respective cavity openings.

* * * * *